US011450976B2

(12) United States Patent
Blackburn

(10) Patent No.: US 11,450,976 B2
(45) Date of Patent: Sep. 20, 2022

(54) GROUND BAR AND METHOD OF GROUNDING

(71) Applicant: Greg Allen Blackburn, Richmond, VA (US)

(72) Inventor: Greg Allen Blackburn, Richmond, VA (US)

( * ) Notice: Subject to any disclaimer, the term of this patent is extended or adjusted under 35 U.S.C. 154(b) by 223 days.

(21) Appl. No.: 16/945,468

(22) Filed: Jul. 31, 2020

(65) Prior Publication Data

US 2021/0044037 A1 Feb. 11, 2021

Related U.S. Application Data

(60) Provisional application No. 62/882,723, filed on Aug. 5, 2019.

(51) Int. Cl.

| | |
|---|---|
| ***H01R 11/01*** | (2006.01) |
| ***H01R 9/26*** | (2006.01) |
| ***H01R 4/64*** | (2006.01) |

(52) U.S. Cl.

CPC ..... *H01R 9/2691* (2013.01); *H01R 4/64* (2013.01)

(58) Field of Classification Search

CPC . H01R 4/643; H01R 4/34; H01R 4/64; H01R 25/142

See application file for complete search history.

(56) References Cited

U.S. PATENT DOCUMENTS

| | | | | |
|---|---|---|---|---|
| D317,434 | S | 6/1991 | McGrane | |
| D317,435 | S | 6/1991 | McGrane | |
| 7,878,562 | B2 | 2/2011 | Hamano et al. | |
| D743,901 | S | 11/2015 | Murphy et al. | |
| D771,571 | S | 11/2016 | Miyamoto | |
| D784,932 | S | 4/2017 | Murphy et al. | |
| D793,190 | S | 8/2017 | Deluccia | |
| 10,122,137 | B2 * | 11/2018 | Baker | H01R 25/168 |
| 2015/0245544 | A1 | 8/2015 | Baumler et al. | |

OTHER PUBLICATIONS

Emerson Vintage-style Ground Plate for Strat, dated Jan. 30, 2017, [online], [site visited Aug. 26, 2020]. Available from Internet, URL: https://www.stewmac.com/electronics/shielding/emerson-vintage-style-ground-plate-for-strat.html (Year: 2017).

Wall Mounted .25"×2"×10" Copper Ground Bar Kit—SCGB-1KT, dated Oct. 30, 2014, [online], [site visited Aug. 26, 2020], Available from Internet, URL: https://www.amazon.com/Wall-Mounted-Copper-Ground-SCGB-1KT/dp/B00GJUZUMI (Year: 2014).

* cited by examiner

*Primary Examiner* — Phuong Chi Thi Nguyen

(74) *Attorney, Agent, or Firm* — Patent Law Of Virginia, PLLC; Brian J. Teague

(57) ABSTRACT

A ground bar comprising a planar body having a wedge shape in that a width of a top end of the planar body is greater than a width of a bottom end of the planar body. The planar body is constructed of an electrically-conductive material. A plurality of upper hole pairs are defined in the planar body. Each of the first hole pairs is adapted to have a corresponding electrical wire to be grounded selectively affixed thereto.

16 Claims, 6 Drawing Sheets

GROUND BAR AND METHOD OF GROUNDING

CROSS-REFERENCE TO RELATED APPLICATIONS

This application claims priority to U.S. Provisional Application Ser. No. 62/882,723, filed Aug. 5, 2019, the contents of which are incorporated herein by reference in its entirety. This application is also related to U.S. Design Patent Application Ser. No. 29/700,681, filed Aug. 5, 2019, the contents of which are incorporated herein by reference in its entirety.

FIELD OF THE INVENTION

The present invention relates generally to ground bars for grounding electrical wires.

BACKGROUND

Communication towers (such as cell tower and radio towers) require proper electrical grounding to prevent equipment damage and to reduce the risk of dangerous electric shocks to personnel working on and around such towers. On typical communication towers, coaxial cables (also termed "coax") are connected to antennas mounted high on the tower, extend down the tower, and lead into a nearby structure to connect to communication equipment (such as transmitters, receivers, etc.). Properly grounding such coaxial cables typically involves attaching the ground shield of each coaxial cable to a ground bar (also termed a ground busbar or grounding busbar). One end of a grounding wire is attached to the ground bar and the other end of the grounding wire is attached to a grounding rod that is driven into the ground.

FIG. 1 illustrates a conventional ground bar. The conventional ground bar 10 of FIG. 1 comprises a conductive main body 12 that is planar and typically either square (not illustrated) or rectangular. The conductive main body 12 is typically constructed of metal, such as copper, stainless steel, or tin-coated copper. A ground bar may attach to a tower or other structure using various different mounting mechanisms. The ground bar 10 of FIG. 1 has two mounting arms 16 at opposing ends of the conductive main body 12. The conductive main body 12 attaches to the mounting arms 16 via bolts 20 and insulators 18 interposed between the conductive main body 12 and the mounting arms 16.

The conductive main body 12 has a plurality of holes 14 defined therein. The holes 14 are typically grouped in pairs, with each pair comprising a circular hole and an elongated hole. The pairs of holes are arranged in two rows. The pairs in each row are parallel to the others in the same row. Each pair of holes is typically vertically aligned with a corresponding pair of holes in the other row. The ground shield of each coaxial cable is attached to a corresponding pair of holes using a two-hole lug. A lug has one end that may be crimped onto a cable and a flat main body with one or more holes defined therein (typically two holes in such an application as described herein). Each hole of each lug is bolted to a corresponding hole of one of the pairs of holes 14. The elongated holes enable each pair of holes to accommodate various sizes of lugs. The grounding wire is also attached to a corresponding pair of holes (typically on the bottom row of hole pairs) using a two-hole lug or is welded to the conductive main body. Although it is generally preferable for each hole pair to have a circular hole and an elongated hole, in alternative embodiments of the invention one, more than one, or all of the hole pairs may have two circular holes or two elongated holes.

FIG. 2 illustrates a conventional ground bar in use on a communication tower. The conventional ground bar 30 of FIG. 2 comprises a conductive main body 32 that is planar and rectangular. The conductive main body 32 is attached to the tower 50 via mounting hardware 36 (with interposed insulator 38). The conductive main body 32 has a plurality of pairs of holes 34 defined therein. The ground shield of each coaxial cable 42 is attached (typically via an intervening conductor 44) to a corresponding pair of holes 34 using a two-hole lug 48. One or more grounding wires 46 (two are shown) are also attached the conductive main body 32 such as by welding (as shown) or using a lug that is bolted to a corresponding pair of holes.

Because of the square or rectangular shape of conventional ground bars and the arrangement of the hole pairs, the electrical pathway from each coaxial cable to the grounding wire is not straight but rather has a sharp bend. Such sharp bends are problematic, especially when dealing with high voltages (e.g., over a few thousand volts). Any induced current that flows through such a curved or bent pathway may tend to jump off the ground bar instead of taking the safe pathway to ground, and may therefore cause personal injury or equipment damage.

BRIEF SUMMARY OF THE DISCLOSURE

In one embodiment of the invention, a ground bar comprises a planar body having a wedge shape in that a width of a top end of the planar body is greater than a width of a bottom end of the planar body. The planar body is constructed of an electrically-conductive material. A plurality of upper hole pairs are defined in the planar body. Each of the upper hole pairs is adapted to have a corresponding electrical wire to be grounded selectively affixed thereto.

The ground bar may further comprise a lower hole pair defined in the planar body adapted to have an electrical ground wire selectively affixed thereto. The lower hole pair may be closer to the lower end of the planar body than are any of the plurality of upper hole pairs. One or more of the upper hole pairs may be positioned such that an imaginary line passing through a center of each hole of a respective upper hole pair intersects with one of the holes of the lower hole pair or with an imaginary line between the holes of the lower hole pair. Each of the upper hole pairs may be positioned such that an imaginary line passing through a center of each hole of a respective upper hole pair intersects with one of the holes of the lower hole pair or with an imaginary line between the holes of the lower hole pair.

In alternative embodiments of the invention, a method of electrically grounding one or more electrical wires comprises affixing a ground bar to a structure, the ground bar comprising a planar body having a wedge shape in that a width of a top end of the planar body is greater than a width of a bottom end of the planar body, wherein the planar body is constructed of an electrically-conductive material, and wherein a plurality of upper hole pairs and a lower hole pair are defined in the planar body; affixing each of one or more electrical wires to be grounded to a respective one of the upper hole pairs; and affixing a ground wire to the lower hole pair.

Affixing the ground bar to a structure may comprise placing one or more non-electrically-conductive spacers between the ground bar and the structure.

In other alternative embodiments of the invention, a ground bar comprises an electrically conductive body. The electrically conductive body comprises a grounding wire connector and a plurality of grounded wire connectors. Each of the plurality of grounded wire connectors are adapted to retain a wire to be grounded such that an axial centerline of each wire to be grounded is aligned with the grounding wire connector.

The body may have a wedge shape in that a width of a top end of the body is greater than a width of a bottom end of the body. The plurality of grounded wire connectors may comprise a plurality of upper hole pairs defined in the body. The grounding wire connector may comprises a lower hole pair defined in the body.

BRIEF DESCRIPTION OF THE SEVERAL VIEWS OF THE DRAWINGS

Reference will now be made to the accompanying drawings, which are not necessarily drawn to scale. The following detailed description of the disclosure will be better understood when read in conjunction with the appended drawings. It should be understood, however, that the disclosure is not limited to the precise arrangements and instrumentalities shown. In the drawings.

DETAILED DESCRIPTION OF THE DISCLOSURE

Figure 1:
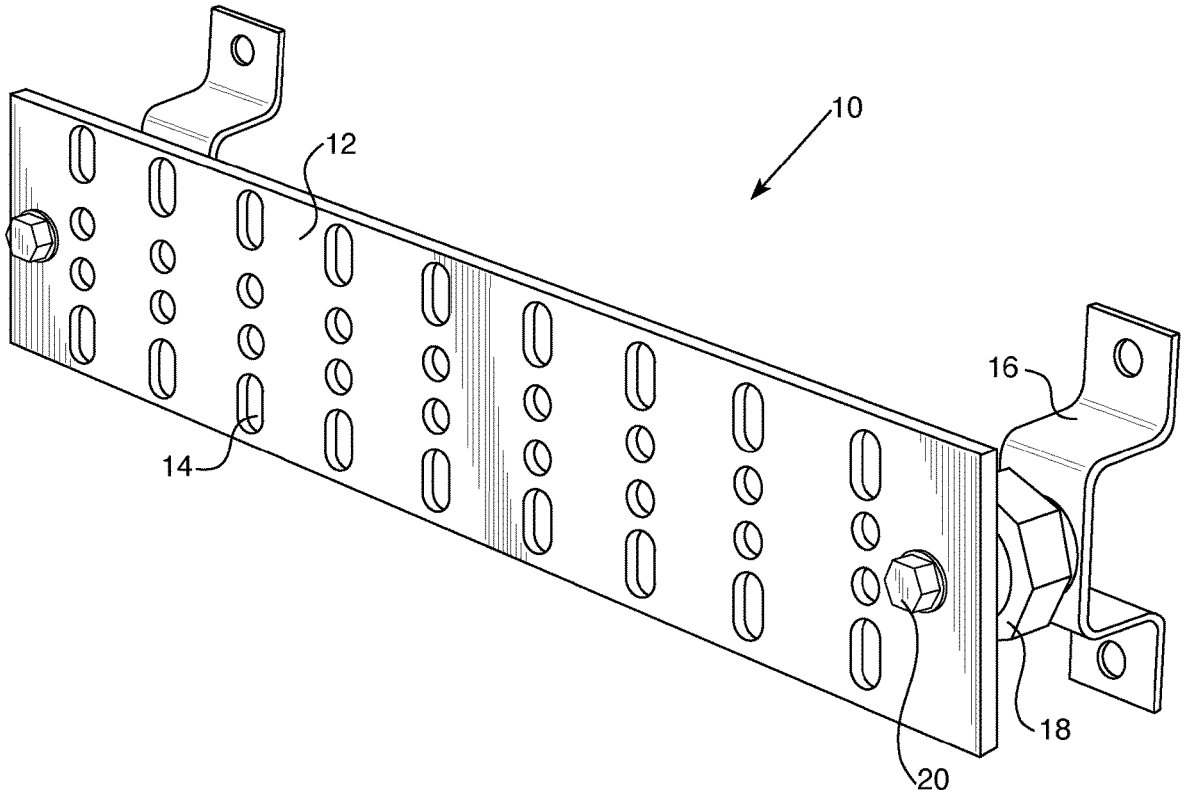
FIG. 1 (Prior Art)
FIG. 1 is a perspective view of a conventional ground bar.
Figure 2:
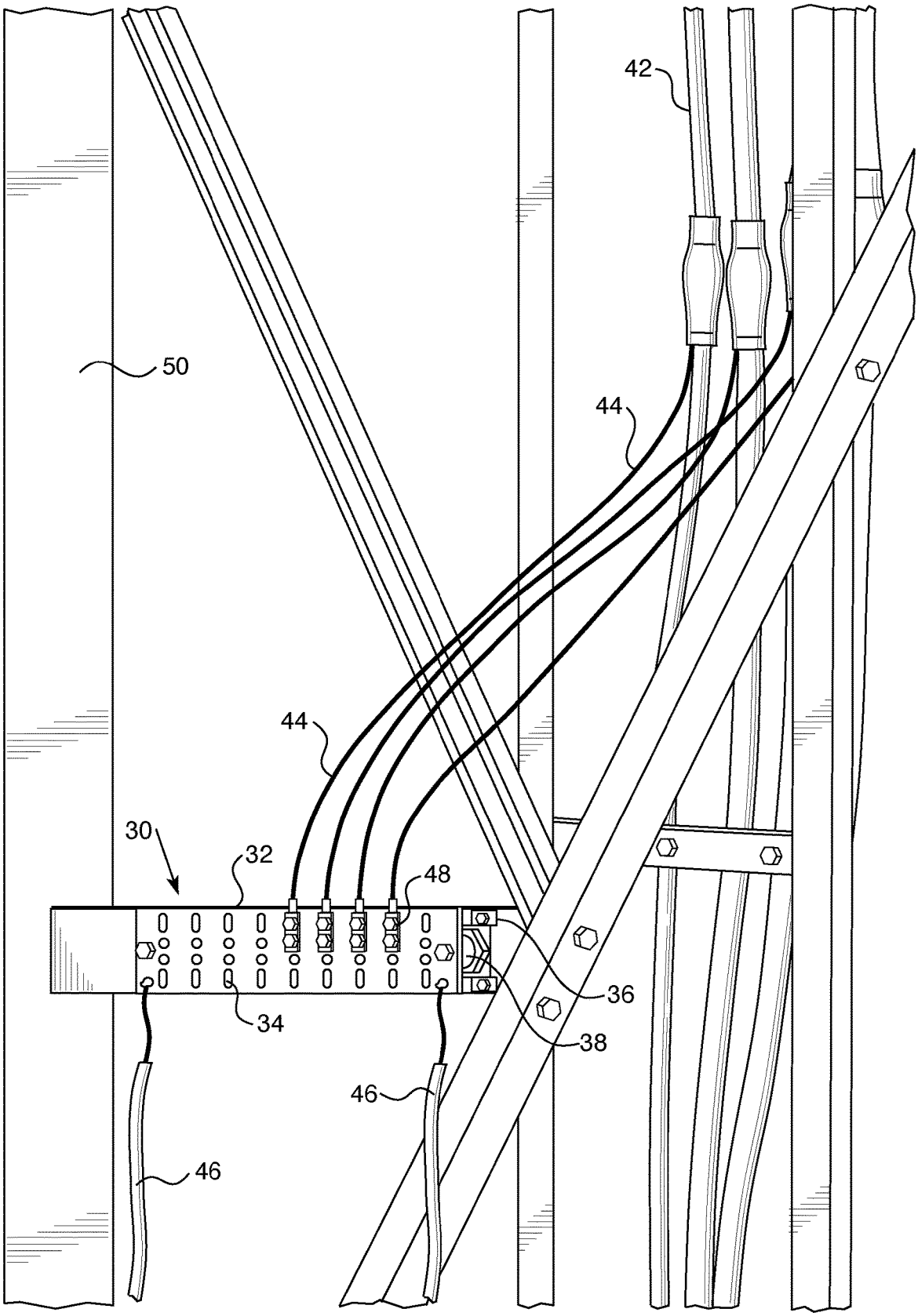
FIG. 2 (Prior Art)
FIG. 2 is a front view of a conventional ground bar in use.

Certain terminology is used in the following description for convenience only and is not limiting. The words "lower," "bottom," "upper," "top," and the like designate directions in the drawings to which reference is made. The words "inwardly," "outwardly," "upwardly," "downwardly," and the like refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Figure 3:
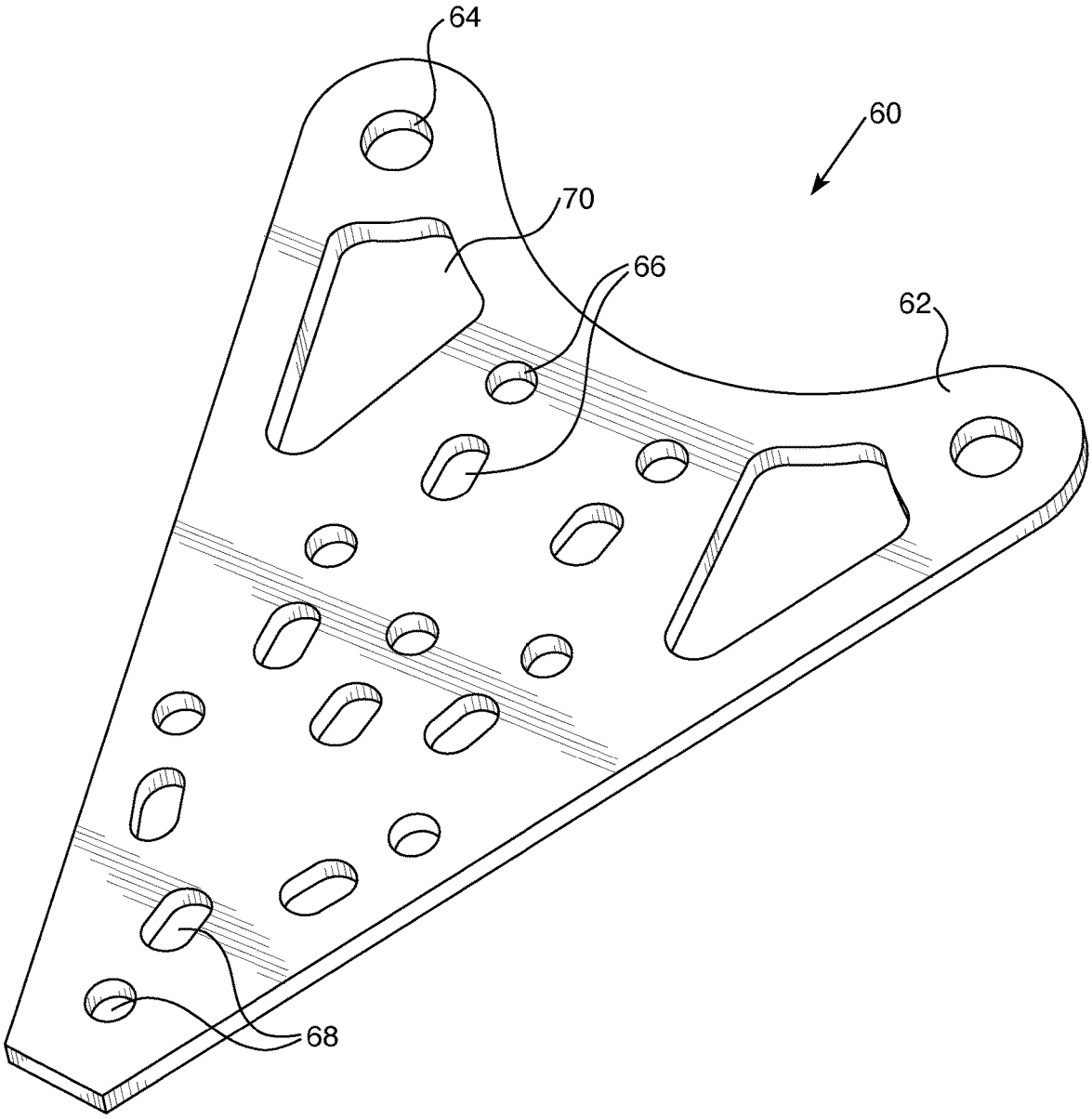
FIG. 3 is a perspective view of a ground bar, in accordance with embodiments of the present invention.
Figure 4:
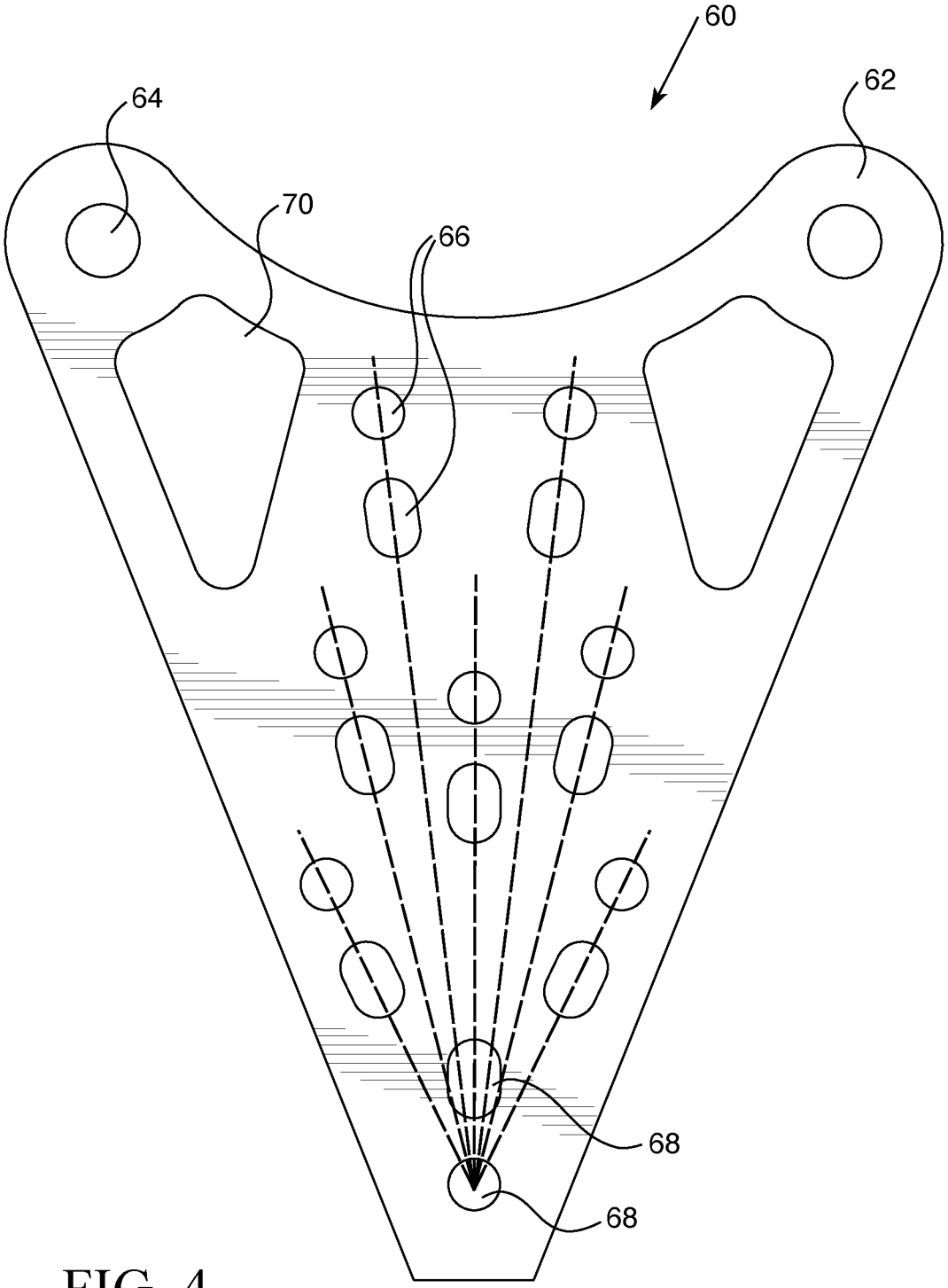
FIG. 4 is a front view of the ground bar of FIG. 3.
Figure 5:
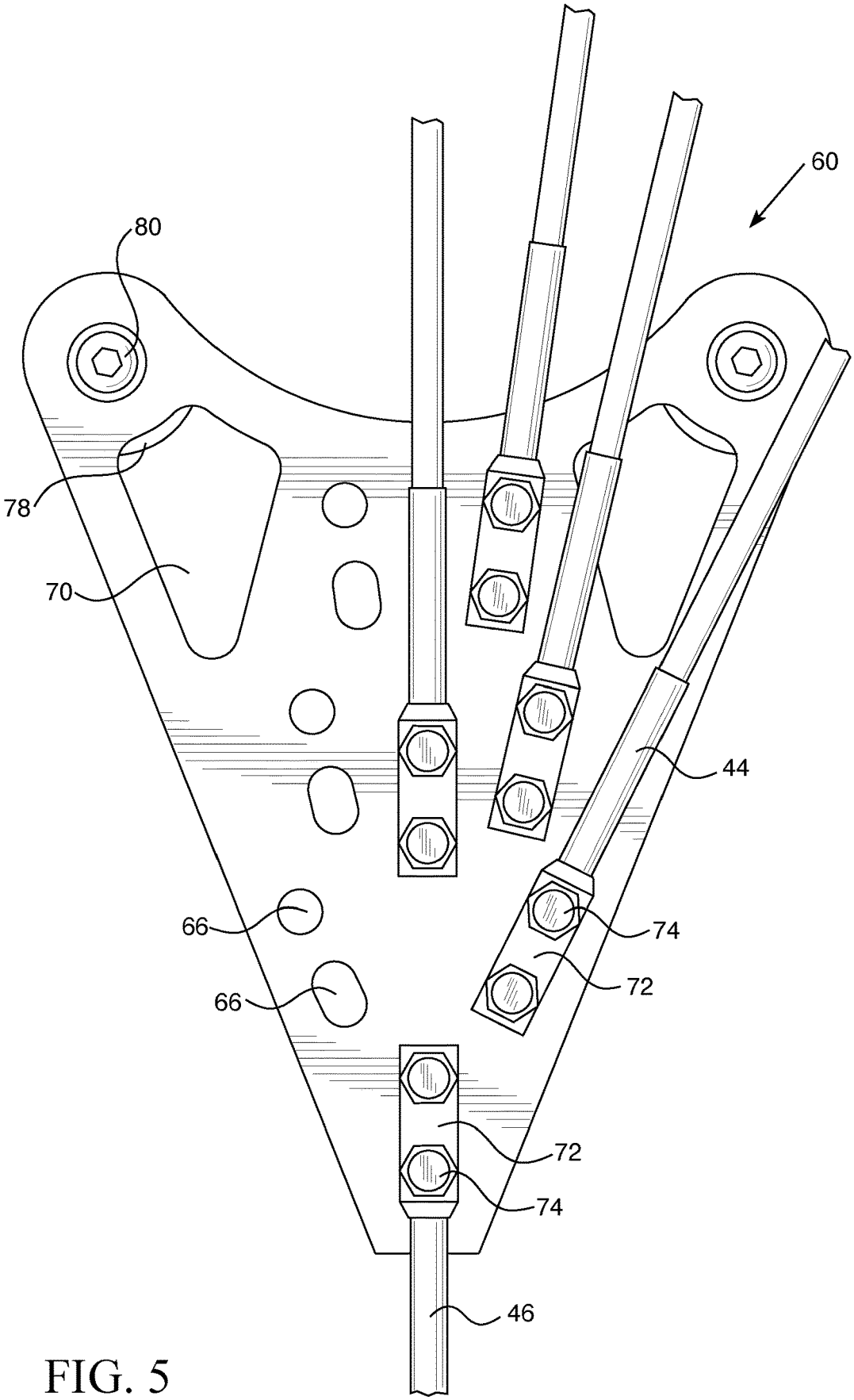
FIG. 5 is a front view of the ground bar of FIG. 3 in use.

Embodiments of the invention comprise a ground bar, such as may be used on a communication tower or in any suitable application. Referring now to FIGS. 3-5, a ground bar of embodiments of the invention is illustrated. The ground bar 60 of embodiments of the invention comprises a conductive planar main body 62. The conductive main body 62 may be constructed of any suitable conductive material (typically metal, such as copper, stainless steel, or tin-coated copper).

The ground bar 60 has two mounting holes 64 defined therein for attaching the ground bar 60 to a structure (such as a communications tower or the like) (typically via bolts 80 and interposed insulators 78 (illustrated in FIG. 5)), although fewer or more mounting holes may be used.

The conductive main body 62 has a plurality of holes 66 defined therein for attaching cables to be grounded. The holes 66 are grouped in pairs, with each pair comprising a circular hole and an elongated hole. Seven pairs of holes 66 are defined in the ground bar 60 of FIGS. 3-5, although fewer or more hole pairs may be defined. With the seven illustrated hole pairs 66, fourteen cables may be grounded using the ground bar 60, as cables may be mounted to both sides of the ground bar 60. As illustrated in FIG. 5, the ground wire from each outer conductor of each coaxial cable 44 (only a short truncated portion of which is shown) is attached to a corresponding pair of holes 66 (not visible in FIG. 5) using a two-hole lug 72. Each hole of each lug 72 is bolted to a corresponding hole of one of the pairs of holes 66 via a bolt/nut 74 (or any other suitable mechanism). Other ground wire connectors may be used, such as clamps, split bolts, tap connectors, crimp connectors, or other appropriate ground connectors.

Another pair of holes 68 is defined at the bottom (i.e., the narrow end) of the ground bar 60. Hole pair 68 is for attaching a grounding wire 46 (as seen in FIG. 5). The grounding wire 46 may be attached using a two-hole lug 72 and bolt/nut 74, or any suitable mechanism. For example, the grounding wire 46 may be welded onto the ground bar 60 (directly or via an attached lug) at approximately the same location as hole pair 68. When the grounding wire is welded to the ground bar, a hole pair for attaching a grounding wire is typically omitted. In such a ground bar, the hole pairs to which the wires to be grounded are attached (e.g., hole pairs 66) are aligned with the weld location. The ground wire may be welded to the ground bar by the ground bar manufacturer, in which case the ground bar is provided with the hole pairs aligned with the weld. Alternatively, the ground wire may be welded to the ground bar by a user, in which case the ground bar is provided with the hole pairs aligned with the location at which the user is instructed/expected to weld the ground wire (i.e., near the bottom end of the ground bar (where the grounding wire hole pairs would be located if included)).

Advantageously, the conductive main body 62 is not square or rectangular, but rather wedge or funnel shaped as seen in the figures. That is, the conductive main body has a wider top end and a narrower bottom end. Additionally, the hole pairs 66 are not arranged parallel to each other as in a conventional ground bar. Rather, the hole pairs 66 are angled such that each hole pair 66 is aligned with or "points at" the hole pair 68 to which the grounding wire is attached. Specifically, "aligned with or points at the hole pair 68" means that each hole pair 66 is aligned with or "points at" either one of the two holes of the hole pair 68 or at the space between the two holes of the hole pair 68. This alignment is best seen in FIG. 4 in which imaginary lines (dashed lines) are superimposed on and aligned with each hole pair 66.

More generally, in some embodiments, "aligns with" or "points to" means that an imaginary arc extending from the imaginary lines (dashed lines) to either or of the two holes of the hole pair 68 or the space between the two holes of the hole pair 68 has a radius not less than the minimum acceptable radius for a ground wire having the conductivity and voltage rating of the connected ground wire. In either embodiment, the ground bar may comprise hole pairs 66 wherein 100% of the hole pairs 66 align with or point at the hole pair 68. In other embodiments, the ground bar comprises at least 50% of the hole pairs 66 being aligned with or pointing at the hole pair 68. In other embodiments, over 75% or over 90% of the hole pairs 66 align with or point at the hole pair 68.

In some embodiments, the ground bar comprises at least two hole pairs 66 that align with or point at the hole pair 68. In some other embodiments, the ground bar comprises at least four hole pairs 66 that align with or point at the hole pair 68. In yet other embodiments, the ground bar comprises at least eight hole pairs 66 or at least twelve hole pairs 66 that align with or point at the hole pair 68.

The combination of the wedge shape of the conductive main body 62 and the alignment of the hole pairs 66 such that each of the hole pairs 66 is aligned with or "points at" the hole pair 68 to which the grounding wire is attached provides a significant advantage over conventional ground bars. Specifically, the ground bar of embodiments of the invention advantageously provides straight electrical pathways between the attachment point of each cable to be grounded and the attachment point of the grounding wire, thereby reducing the likelihood that any induced current will jump off the ground bar instead of taking the intended pathway to ground.

It may be possible to have only one or the other of these advantageous features and still provide an improvement over conventional ground bars. That is, having the wedge shape but not the alignment between each of the hole pairs 66 and the hole pair 68, or having the alignment between each of the hole pairs 66 and the hole pair 68 but not the wedge shape (e.g., the ground bar main body could be square, rectangular, or other shapes), may provide some improvement over conventional ground bars. However, having both of these features is preferred.

The ground bar 60 of embodiments of the invention may have additional holes 70 defined in the conductive main body 62. Such holes 70 reduce the total amount of material used to manufacture the ground bar, thereby reducing cost. Such holes 70 also prevent the attachment of cables too close to the mounting holes 64 and inhibit a direct electrical pathway between any of the attached cables and the mounting holes 64. The mounting holes are preferably higher on the planar main body (i.e., closer to the wider top end) than are any of the mounting hole pairs 66 or the grounding wire hole pair 68, which also helps inhibit a direct electrical pathway between any of the attached cables and the mounting holes.

In one exemplary embodiment of the invention, the conductive main body is about ten inches tall, about seven inches wide at the top, and about 0.25 inches thick. However, the conductive main body may be any suitable size. In the illustrated embodiment, the outer edges of the device and the edges of the holes are sharp (i.e., at or about 90 degrees). In alternative embodiments of the invention (not illustrated) the outer edges of the device and/or the edges of the holes may be rounded or beveled. Any suitable radius of rounding may be used, up to one-half of the thickness of the device which would produce a full bullnose edge.

Figure 6:
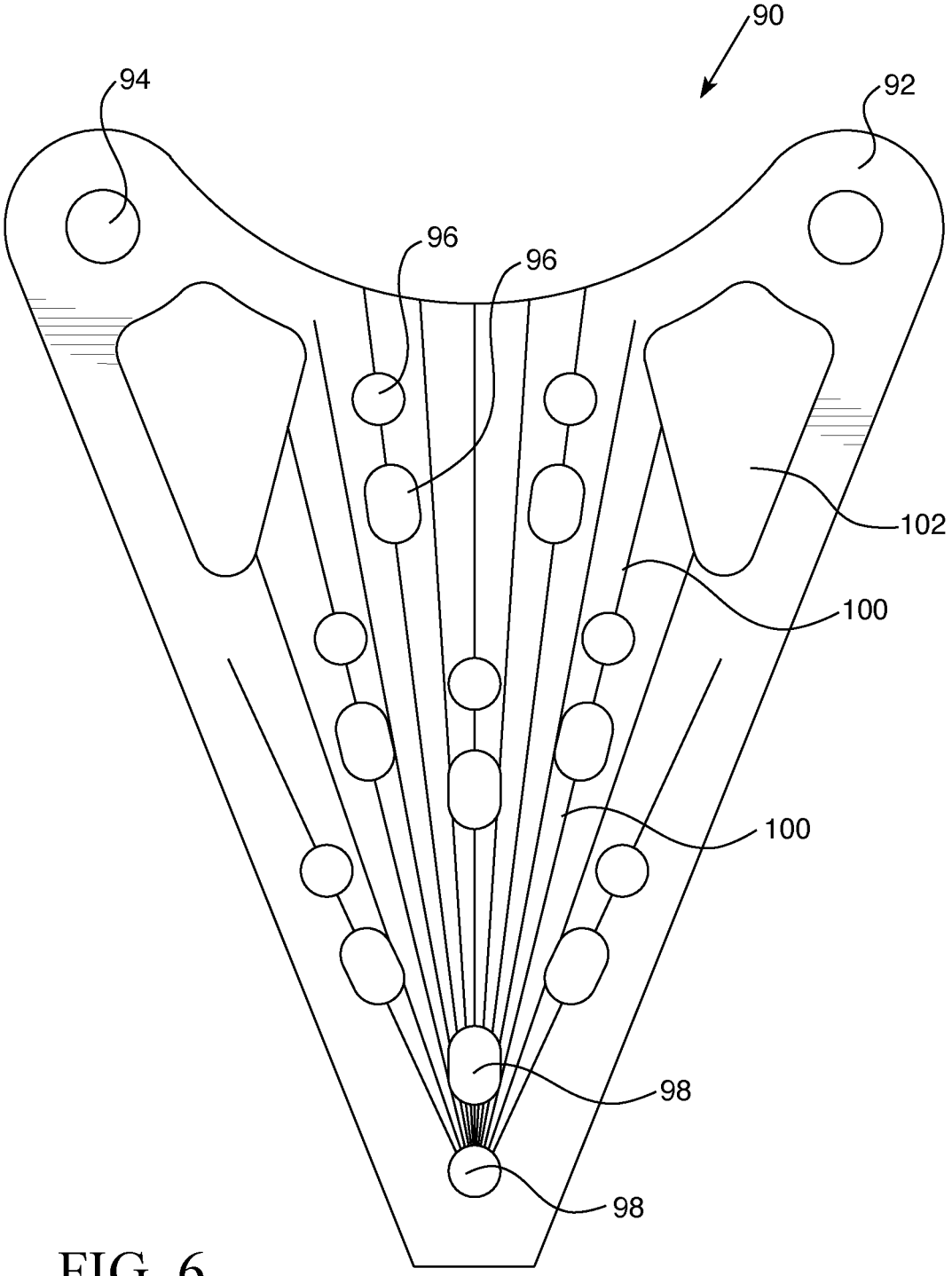
FIG. 6 is a front view of a ground bar, in accordance with alternative embodiments of the invention.

In alternative embodiments of the invention, a texture or artificial grain may be defined in one or (preferably) both planar sides of the ground bar. The purpose of the texture is to aid in keeping the plasma from an electric arc flowing in toward the grounding hole pair and not away from it. Referring now to FIG. 6, a ground bar 90 of alternative embodiments of the invention is illustrated. The ground bar 90 is nearly identical to the ground bar 60 of FIGS. 3-5, in that ground bar 90 comprises a conductive planar main body 92, two mounting holes 94 defined therein, a plurality of holes 96 defined therein for attaching cables to be grounded, and a pair of holes 98 defined at the bottom (i.e., the narrow end) of the ground bar 90 for attaching a grounding wire. Additionally, the ground bar 90 has a plurality of shallow grooves or channels 100 defined in one or (preferably) both planar sides to add texture.

The grooves 100 are positioned such that the grooves are arranged generally in a fan pattern. In this regard, the grooves 100 run generally from the hole pairs 96 toward the hole pairs 98. Thirteen grooves 100 are illustrated in FIG. 6; however, the actual number of grooves in a ground bar of embodiments of the invention will likely be much higher (e.g., two to ten times (or more) as many grooves as are illustrated). The grooves can be applied by sanding, grinding, lasering, or other suitable method and shall be deeper that the natural grain of the metal. The idea is to just overpower or replace the depth of the grain of the metal from when it was formed, so the grain only needs to be slightly deeper than the natural grain of the metal (which will vary depending on the specific metal(s) used and the method by which the ground bar is constructed. Too much depth of a texture and the small peaks and ridges becomes jumping off points for the arc. In one exemplary embodiment of the invention, the grooves are less than one micron deep. As is illustrated, the grooves will preferably cover most of the planar surface of the main body except the area above and lateral to the material-reducing holes 102 and the area below the bottom one of the ground holes 98.

Embodiments of the invention may also comprise a method of grounding a plurality of cables by attaching the cables to be grounded to a wedge or funnel shaped ground bar as described herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A ground bar comprising:

a planar body having a wedge shape in that a width of a top end of the planar body is greater than a width of a bottom end of the planar body;

wherein the planar body is constructed of an electrically-conductive material;

wherein a plurality of upper hole pairs are defined in the planar body, each of the upper hole pairs adapted to have a corresponding electrical wire to be grounded selectively affixed thereto;

wherein a lower hole pair is defined in the planar body adapted to have an electrical ground wire selectively affixed thereto.

2. The ground bar of claim 1, wherein the lower hole pair is closer to the lower end of the planar body than are any of the plurality of upper hole pairs.

3. The ground bar of claim 1, wherein one or more of the upper hole pairs are positioned such that an imaginary line passing through a center of each hole of a respective upper hole pair intersects with one of the holes of the lower hole pair or with an imaginary line between the holes of the lower hole pair.

4. The ground bar of claim 1, wherein each of the upper hole pairs are positioned such that an imaginary line passing through a center of each hole of a respective upper hole pair intersects with one of the holes of the lower hole pair or with an imaginary line between the holes of the lower hole pair.

5. A method of electrically grounding one or more electrical wires, the method comprising:

affixing a ground bar to a structure, the ground bar comprising a planar body having a wedge shape in that a width of a top end of the planar body is greater than a width of a bottom end of the planar body, wherein the planar body is constructed of an electrically-conductive material, and wherein a plurality of upper hole pairs and a lower hole pair are defined in the planar body;

affixing each of one or more electrical wires to be grounded to a respective one of the upper hole pairs; and affixing a ground wire to the lower hole pair.

6. The method of claim 5, wherein the lower hole pair is closer to the lower end of the planar body than any of the plurality of upper hole pairs.

7. The method of claim 5, wherein one or more of the upper hole pairs are positioned such that an imaginary line passing through a center of each hole of a respective upper hole pair intersects with one of the holes of the lower hole pair or with an imaginary line between the holes of the lower hole pair.

8. The method of claim 5, wherein each of the upper hole pairs are positioned such that an imaginary line passing through a center of each hole of a respective upper hole pair intersects with one of the holes of the lower hole pair or with an imaginary line between the holes of the lower hole pair.

9. The method of claim 5, wherein affixing the ground bar to a structure comprises placing one or more non-electrically-conductive spacers between the ground bar and the structure.

10. A ground bar comprising:

an electrically conductive body having a wedge shape in that a width of a top end of the body is greater than a width of a bottom end of the body, wherein the electrically conductive body comprises:

a grounding wire connector comprising a lower hole pair defined in the body adapted to have an electrical ground wire selectively affixed thereto; and a plurality of grounded wire connectors comprising a plurality of upper hole pairs defined in the body, wherein each of the plurality of grounded wire connectors are adapted to retain a wire to be grounded such that an axial centerline of each wire to be grounded is aligned with the grounding wire connector.

11. The ground bar of claim 10, wherein the body has a wedge shape in that a width of a top end of the body is greater than a width of a bottom end of the body.

12. The ground bar of claim 10, wherein the plurality of grounded wire connectors comprise a plurality of upper hole pairs defined in the body.

13. The ground bar of claim 10, wherein the grounding wire connector comprises a lower hole pair defined in the body.

14. The ground bar of claim 13, wherein the lower hole pair is closer to a lower end of the body than are any of the plurality of upper hole pairs.

15. The ground bar of claim 13, wherein one or more of the upper hole pairs are positioned such that an imaginary line passing through a center of each hole of a respective upper hole pair intersects with one of the holes of the lower hole pair or with an imaginary line between the holes of the lower hole pair.

16. The ground bar of claim 13, wherein each of the upper hole pairs are positioned such that an imaginary line passing through a center of each hole of a respective upper hole pair intersects with one of the holes of the lower hole pair or with an imaginary line between the holes of the lower hole pair.

* * * * *